US011230838B1

(12) United States Patent
Mendez-Vazquez et al.

(10) Patent No.: US 11,230,838 B1
(45) Date of Patent: Jan. 25, 2022

(54) STRUCTURAL STEEL PLUG FOR BI-AXIAL MOMENT CONNECTIONS

(71) Applicants: Wilfredo Mendez-Vazquez, San Sebastian, PR (US); Esmeralda Nino-Perez, San Sebastian, PR (US)

(72) Inventors: Wilfredo Mendez-Vazquez, San Sebastian, PR (US); Esmeralda Nino-Perez, San Sebastian, PR (US)

( * ) Notice: Subject to any disclaimer, the term of this patent is extended or adjusted under 35 U.S.C. 154(b) by 0 days.

(21) Appl. No.: 17/013,709

(22) Filed: Sep. 7, 2020

Related U.S. Application Data

(60) Provisional application No. 62/897,382, filed on Sep. 8, 2019.

(51) Int. Cl.

| | |
|---|---|
| ***E04B 1/38*** | (2006.01) |
| ***E04B 1/41*** | (2006.01) |
| ***E04B 1/61*** | (2006.01) |
| ***E04B 1/24*** | (2006.01) |

(52) U.S. Cl.
CPC ..... *E04B 1/40* (2013.01); *E04B 1/2403* (2013.01); *E04B 1/54* (2013.01); *E04B 2001/2415* (2013.01); *E04B 2001/2424* (2013.01); *E04B 2001/405* (2013.01)

(58) Field of Classification Search
None
See application file for complete search history.

(56) References Cited

U.S. PATENT DOCUMENTS

| | | | | |
|---|---|---|---|---|
| 2,926,941 | A * | 3/1960 | Thompson | F16B 7/0446 403/173 |
| 4,558,968 | A * | 12/1985 | Meickl | E04B 1/58 403/174 |
| 4,934,858 | A * | 6/1990 | Beaulieu | F16B 12/40 403/174 |
| 5,044,137 | A * | 9/1991 | Shigeru | E04B 1/2604 52/286 |
| 5,048,995 | A * | 9/1991 | Beaulieu | F16B 7/0473 403/264 |
| 7,310,920 | B2 * | 12/2007 | Hovey, Jr. | E04B 1/24 52/282.1 |
| 7,637,076 | B2 * | 12/2009 | Vaughn | E04C 3/06 52/838 |
| 9,212,675 | B2 * | 12/2015 | Oetlinger | F16B 7/187 |
| 9,249,593 | B2 * | 2/2016 | Perko | E04H 9/145 |
| 10,179,991 | B2 * | 1/2019 | Houghton | E04B 1/2403 |
| 10,368,639 | B1 * | 8/2019 | Lai | A47B 96/1433 |
| 2007/0186503 | A1 * | 8/2007 | Homma | E04B 1/2604 52/655.1 |

(Continued)

*Primary Examiner* — Basil S Katcheves
(74) *Attorney, Agent, or Firm* — Luis Figarella

(57) ABSTRACT

A standardized structural metal plug assembly that, when welded to metal columns and beams, allows to join them together into a bi-axial moment connection without bolts or on-site welding. The plug is assembled in a gravity and interlocking fashion. It is composed of one flange cruciform joint that works as a "male" outward component that channels the beam's "female" inward bracket into its seated and locked position. The column terminals also act as "female" inward component that slips and seats over the flange cruciform joint ends. All the components are lock-in-place to the flange cruciform joint due to various mechanical locking latches attached to the beam brackets and column terminals.

10 Claims, 26 Drawing Sheets

(56) References Cited

U.S. PATENT DOCUMENTS

2007/0261356 A1* 11/2007 Vaughn ..... F16B 9/02
52/655.1
2013/0326993 A1* 12/2013 Schold ..... E04B 1/26
52/655.1

* cited by examiner

Figure 23
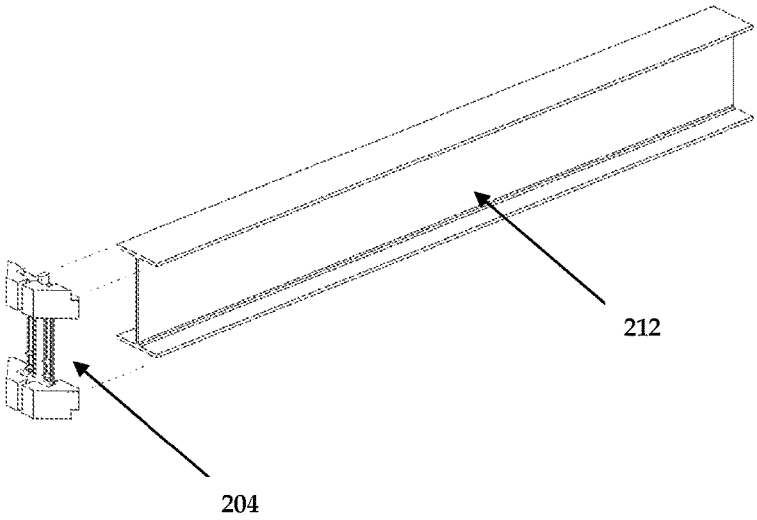
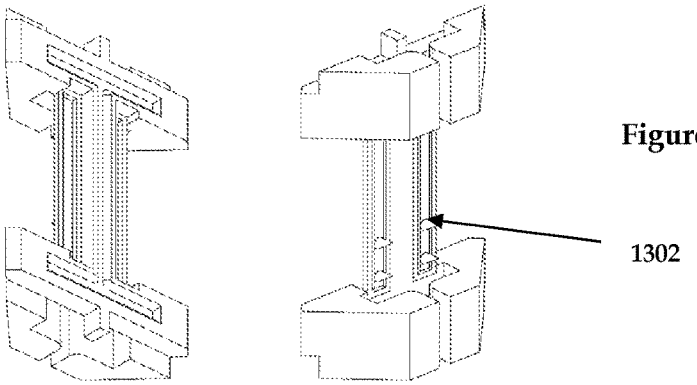
Figure 24

STRUCTURAL STEEL PLUG FOR BI-AXIAL MOMENT CONNECTIONS

CROSS-REFERENCE TO RELATED APPLICATIONS

This application claims priority to U.S. Provisional patent application Ser. No. 62/897,382 titled "Structural Steel Plug for Bi-Axial Moment Connections", filed on Sep. 8, 2019 the disclosure of which is herein incorporated by reference in its entirety.

PATENTS CITED

The following documents and references are incorporated by reference in their entirety, Holscher (US Pat. Pub. No. 2006/0110215), Houghton (U.S. Pat. No. 9,506,239), Simmons (U.S. Pat. No. 7,941,985), Sterling Foundry (GB 1204327), Higgins (U.S. Pat. No. 5,289,665) and Juola (U.S. Pat. No. 5,678,375).

FIELD OF THE INVENTION

The present invention relates broadly to the field of building construction, steelwork erection and, in particular, the installation of steel connections for building structures.

DESCRIPTION OF THE RELATED ART

The construction industry is facing a dangerous and expensive labor and skill shortage that shows no sign of abating. Diverse sectors within the industry are already dealing with the effects of this problem. Real estate developers, builders, contractors, engineers and manufacturers are those mostly impacted by this. Furthermore, the problem turns critical in vulnerable areas such as the coasts as well as seismic intensive/active zones.

In the case of structural steel manufacturers and erectors, finding and retaining trained labor capable of erecting building steelwork on site is a constant challenge. With new projects every two or three months, these companies have to search extensively for new skilled labor, skilled welders, and younger workers that are less and less trained (compared to earlier generations) in order to comply with their customer's requests of building safe and fast.

The above is particularly acute for steel manufacturers in the multi-story building development. The main problem they face is finding younger and engaged specialized labor to cut, weld and install the steelwork on site. This leads to higher installation costs and very often, construction delays. Today, their best option is to recruit skilled labor from the competition at higher wages, or invest in training younger generations hoping they will ultimately enter the labor pool. With time, this problem will only get worse.

If there was an easier way to install the steelwork on site, then steel manufacturers and erectors could require less trained labor, and with over 1,000 steel manufacturers and erectors in the United States alone, there is a clear opportunity to meaningfully impact the building industry.

SUMMARY OF THE INVENTION

This section is for the purpose of summarizing some aspects of the present invention and to briefly introduce some embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e., that it will be taken to mean an inclusion of not only the listed components it directly references, but also other non-specified components or elements. This rationale will also be used when the term 'comprised' or 'comprising' is used in relation to one or more steps in a method or process.

In one aspect, the invention is about a gravity assisted, standardized structural plug assembly for joining structural members together in an interlocking, bi-axial moment resistant connection, said assembly comprising a flange cruciform joint having one or more outward flanges, one or more column terminals, each said terminal designed to host within it all or a portion of said outward flange and one or more brackets, each said bracket designed to attach to one said outward flange. In another aspect said terminal has one or more deflecting latches along one or more of said terminal's sides, and said terminal has a one more inward sockets at one end sized to support said flange cruciform joint and one or more of said outward flanges has one or more openings complementary to said terminal's deflecting latches. In yet another aspect said bracket has one or more deflecting latches complementary to said outward flange openings. In another aspect said terminal has one or more indentations along said terminal's edge periphery and said bracket has one or more tabs that are complementary to said terminal indentations extending from one or more ends of said bracket. In yet another aspect said bracket has a side designed to be permanently coupled to one or more beams and said terminal has an end designed to be permanently couple to one column.

In another aspect said bracket permanent coupling to said beams is designed to be accomplished through either mechanical components, welding and/or chemical attachment and said terminal permanent coupling to said column is designed to be accomplished through either mechanical components, welding and/or chemical attachment. In yet another aspect said bracket has one or more indentations along said bracket's edge periphery and said terminal has one or more tabs that are complementary to said bracket's indentations extending from one or more ends of said terminal. In another aspect said bracket has a side designed to be permanently coupled to one or more beams and said terminal has an end designed to be permanently couple to one column. In yet another aspect said bracket permanent coupling to said beams is designed to be accomplished through either mechanical components, welding and/or chemical attachment and said terminal permanent coupling to said column is designed to be accomplished through either mechanical components, welding and/or chemical attachment.

In one aspect, the invention is about a method for assembling a gravity assisted, standardized structural plug assembly for joining structural members together in an interlocking, bi-axial moment resistant connection, said method comprising providing a flange cruciform joint having one or more outward flanges, providing one or more column terminals, each said terminal designed to host within it all or a portion of said outward flange, providing one or more brackets, each said bracket designed to attach to one said outward flange and sitting at least one said flange cruciform joint on at least one said terminal and sliding at least one said bracket having a beam attached to it on one said outward flange, then attaching said terminal to a column and capping said flange cruciform with an upper terminal. In another aspect said terminal has one or more deflecting latches along one or more of said terminal's sides, and said terminal has a one more inward sockets at one end sized to support said flange cruciform joint and one or more of said outward flanges has one or more openings complementary to said terminal's deflecting latches. In yet another aspect said bracket has one or more deflecting latches complementary to said outward flange openings.

In another aspect said terminal has one or more indentations along said terminal's edge periphery and said bracket has one or more tabs that are complementary to said terminal indentations extending from one or more ends of said bracket. In yet another aspect said bracket has a side designed to be permanently coupled to one or more beams and said terminal has an end designed to be permanently couple to one column. In another aspect said bracket permanent coupling to said beams is designed to be accomplished through either mechanical components, welding and/or chemical attachment and said terminal permanent coupling to said column is designed to be accomplished through either mechanical components, welding and/or chemical attachment.

In one aspect, the invention is about a gravity assisted, standardized structural plug assembly for joining structural members together in an interlocking, bi-axial moment resistant connection, said assembly comprising providing a flange cruciform joint having one or more outward flanges at a first end and one or more column attachment components at a second end and one or more brackets, each said bracket having a first end having two or more slides designed to attach to one said outward flange and one or more beam attachment components at a second end. In another aspect each said bracket has one or more deflecting latches along one or more of said bracket's first sides and one or more of said outward flanges has one or more openings complementary to said bracket's deflecting latches. In yet another aspect said bracket's permanent coupling to said beams is designed to be accomplished through either mechanical components, welding and/or chemical attachment; and said cruciform joint permanent coupling to said column is designed to be accomplished through either mechanical components, welding and/or chemical attachment. In another aspect said bracket's permanent coupling mechanical components are comprised of rivets, clips and/or screw and said cruciform joint's permanent coupling mechanical components are comprised of rivets, clips and/or screws.

In one aspect, the invention is about a system for assembling a gravity assisted, standardized structural plug assembly for joining structural members together in an interlocking, bi-axial moment resistant connection, said system comprising providing a flange cruciform joint having one or more outward flanges, one or more column terminals, each said terminal designed to host within it all or a portion of said outward flange, one or more brackets, each said bracket designed to attach to one said outward flange and sitting at least one said flange cruciform joint on at least one said terminal and sliding at least one said bracket having a beam attached to it on one said outward flange, then attaching said terminal to a column and capping said flange cruciform joint with an upper terminal. In another aspect said terminal has one or more deflecting latches along one or more of said terminal's sides, and said terminal has a one more inward sockets at one end sized to support said flange cruciform joint and one or more of said outward flanges has one or more openings complementary to said terminal's deflecting latches. In yet another aspect said bracket has one or more deflecting latches complementary to said outward flange openings.

In another aspect said terminal has one or more indentations along said terminal's edge periphery and said bracket has one or more tabs that are complementary to said terminal indentations extending from one or more ends of said bracket. In yet another aspect said bracket has a side designed to be permanently coupled to one or more beams and said terminal has an end designed to be permanently couple to one column. In another aspect said bracket permanent coupling to said beams is designed to be accomplished through either mechanical components, welding and/or chemical attachment and said terminal permanent coupling to said column is designed to be accomplished through either mechanical components, welding and/or chemical attachment.

Other features and advantages of the present invention will become apparent upon examining the following detailed description of an embodiment thereof, taken in conjunction with the attached drawings.

BRIEF DESCRIPTION OF THE DRAWINGS

FIG. 23 shows an axonometric view of the bracket and the beam, according to an exemplary embodiment of the invention.

FIG. 24 shows an axonometric view of front and back of the bracket, including details of the bracket latches, according to an exemplary embodiment of the invention.

Figure 1:
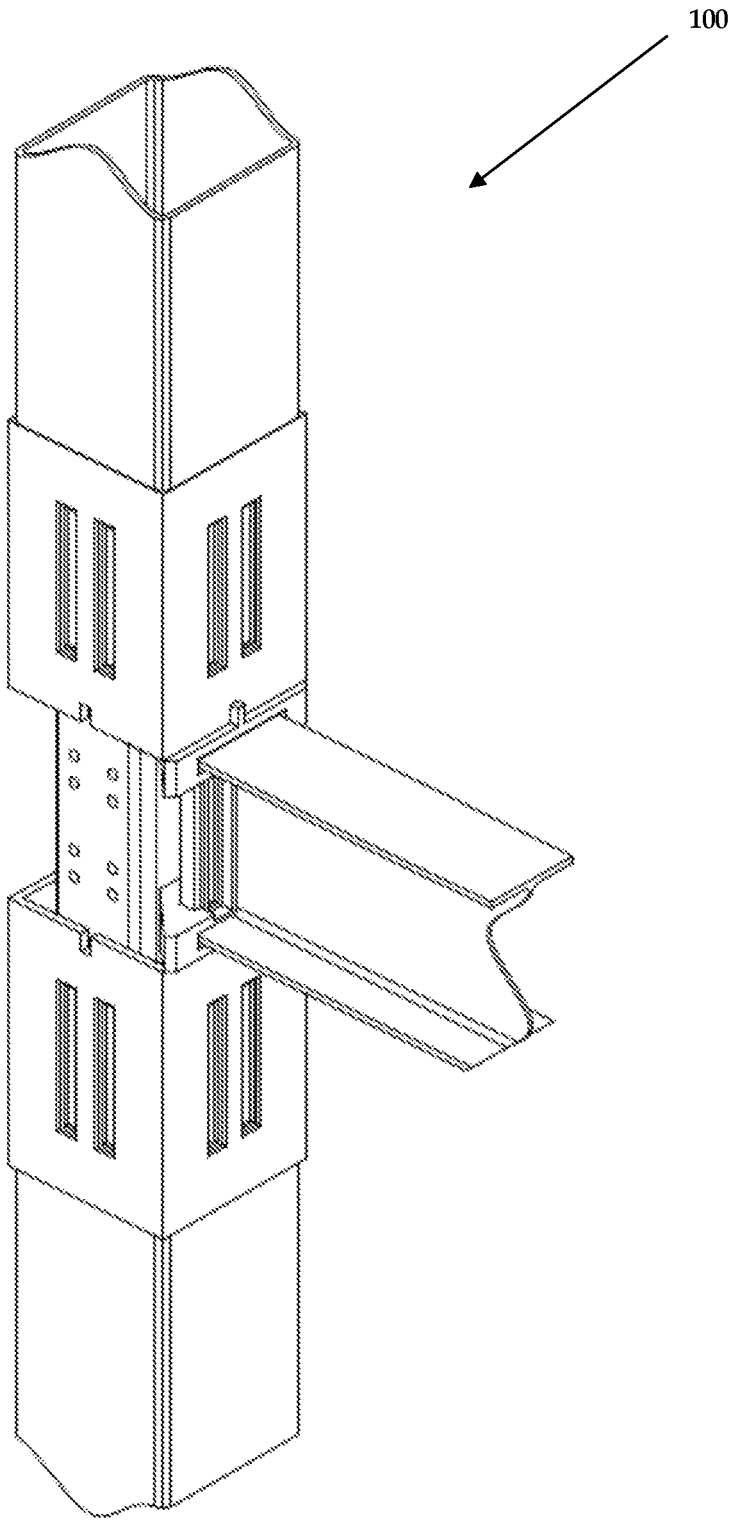
FIG. 1 is an axonometric view of a structural steel Hollow Square Section (HSS) column connected to a steel Wide Flange (WF) beam, according to an exemplary embodiment of the invention.

The above-described and other features will be appreciated and understood by those skilled in the art from the following detailed description, drawings, and appended claims.

DETAILED DESCRIPTION OF THE INVENTION

This section is for the purpose of summarizing some aspects of the present invention and to briefly introduce some embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Referring to FIG. 1, we see an embodiment 100 of the present invention, a standardized structural metal plug that, when welded to structural beams and metal columns, turns into a plug-in bi-axial moment connection that can be securely assembled without bolts or on-site welding. Note in one embodiment, we describe the plug as a steel member connected to steel columns, but in fact these may be any ferrous or non-ferrous metals or composites capable of carrying significant loads.

Figure 2:
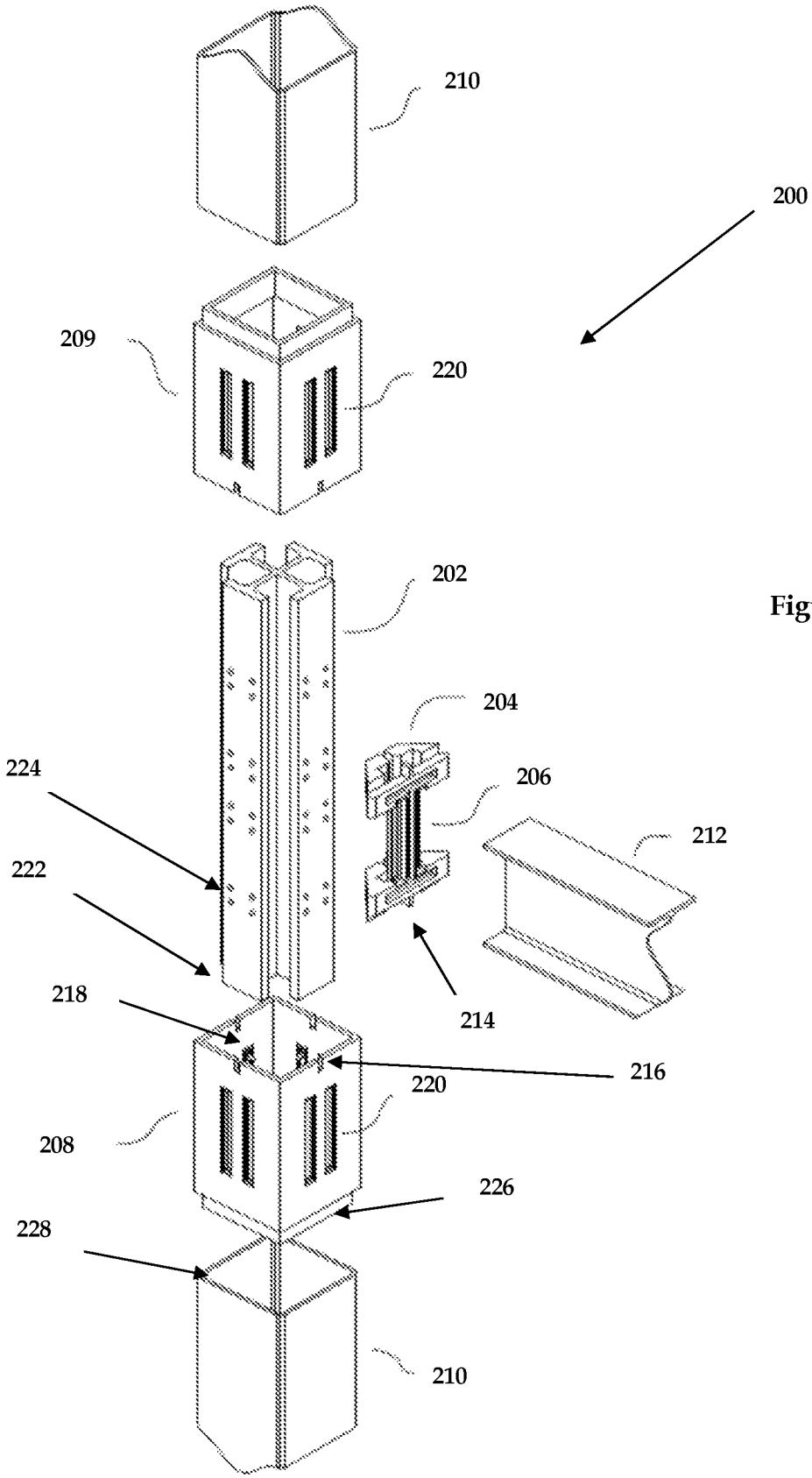
FIG. 2 is an exploded axonometric view of a connection between a structural steel Hollow Square Section (HSS) to a steel Wide Flange (WF) beam, according to an exemplary embodiment of the invention.

As seen in FIG. 2, the plug 200 is assembled in a gravity and interlocking fashion. It is composed of one interlocking flange cruciform joint 202 having one or more T-ends 230 that work as a "male" outward component that channels the beam's "female" inward bracket 204 into its seat and locked position. The column terminals 208/209 acts as "female" or receiver inward component (on both the top and bottom of the flange 202) that slips and seats the flange 202 cruciform joint ends 222 into the terminal's 208/209 bottom edge 226 which is also designed to fit onto the top/bottom columns 210.

In one embodiment, the flange 202 is centered on the terminal 208/209 thanks to a center notch 216 within the terminal 208/209 designed to host the bracket's indent 214. Note that in an alternate embodiment, the notch/tab-indent order may be reversed. All the components are lock-in-place to the flange cruciform joint 202 one or more outward flanges 230 (the T-joint shape on the outside) due to various mechanical deflecting latches 218 attached to the brackets and terminals and accessible once mounted via the latch access slot 220, said latches being complementary to the one or more openings or slots 224 placed along the outward flange 230, at either the fascia or any other portion of the outward flange 230 surface at/near/in contact with said bracket 204 or terminal 208/209.

While we say steel columns 210 and beams 212/402 and other described components may be comprised of any suitable materials, including one or more suitable metal and/or metal or metal/composite combinations (including ferrous metals such as steel and stainless steel, as well as non-ferrous metals such as copper and aluminum). The beams are usually called hollow square sections (HSS) or wide-flange (WF) shaped components, although those skilled in the art will recognize that other shapes are possible and would work as well. The terminals 208/209 are hollow square shapes (with a complementary shape at the column end 210), and in one embodiment have "female" inward sockets 226 designed to go into the column end 228 (Again, they may be external so the column end 228 is the female).

The "female" 226 end inward terminals 208/209 (above and below) are welded to both ends of the column 210. Each terminal 208/209 contains several latches 218 designed to match complementary forms 224 in the flange 202. In one embodiment, the plug 200 is assembled using gravity, the flange 202 cruciform joint slips through the column lower terminal 208 and into its seat position. In one embodiment, each column's lower terminal 208 provides a terminal end, seat feature or column/beam attachment interface 226 for the flange 202 cruciform joint that locks the entire system in the downward direction. The column's upper terminal 209 slips over and seats on the flange 202 cruciform joint top. The column terminals 208/209 and the flange 202 cruciform joint ends overlap to assure the load transfer and lateral load performance. In the upward direction, latches on both terminals 218 securely fasten the columns to the flange cruciform joint 202 through several holes 224 in the flanges.

Figure 3:
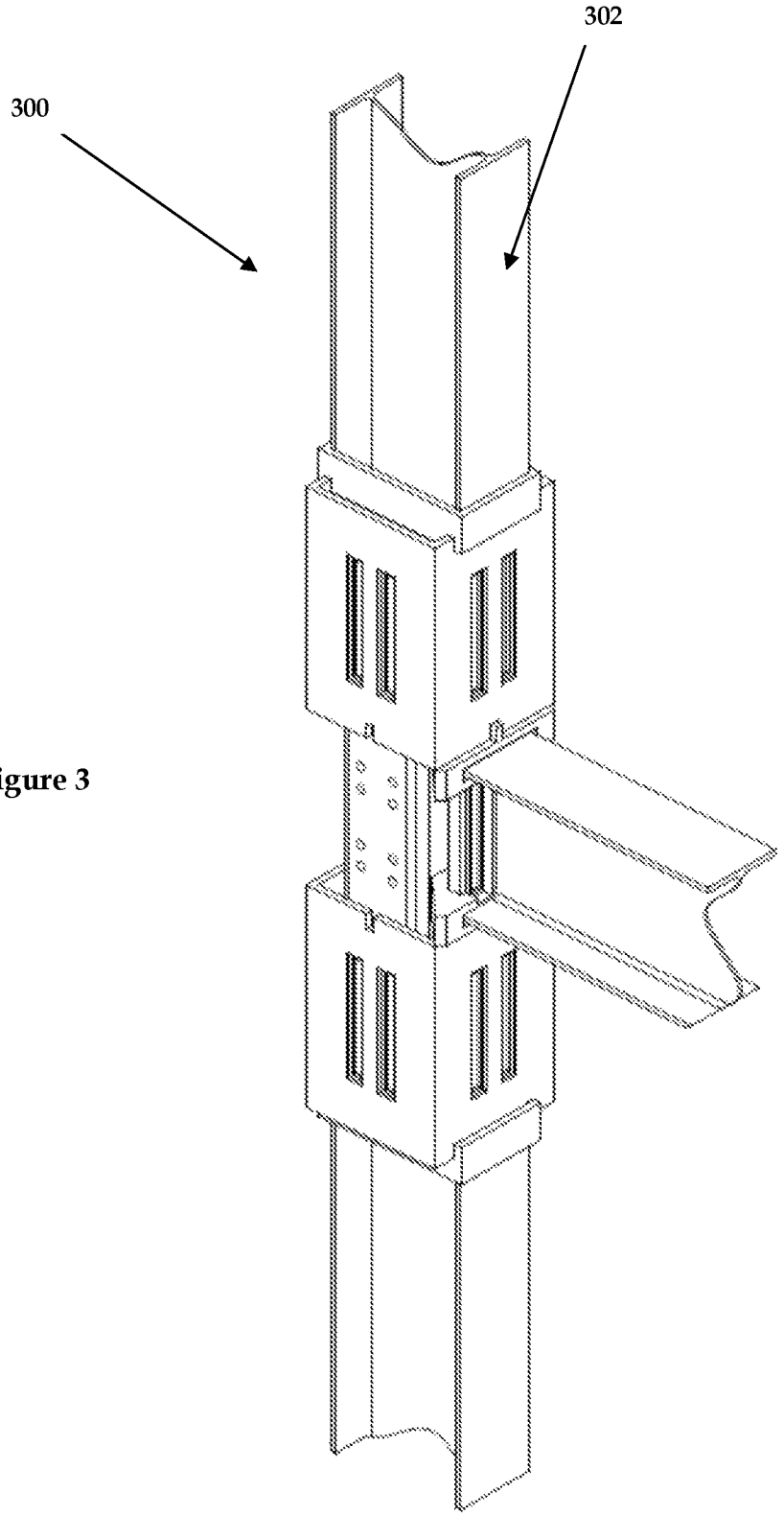
FIG. 3 is an axonometric view of a Wide Flange (WF) beam and column assembly, according to an exemplary embodiment of the invention.
Figure 4:
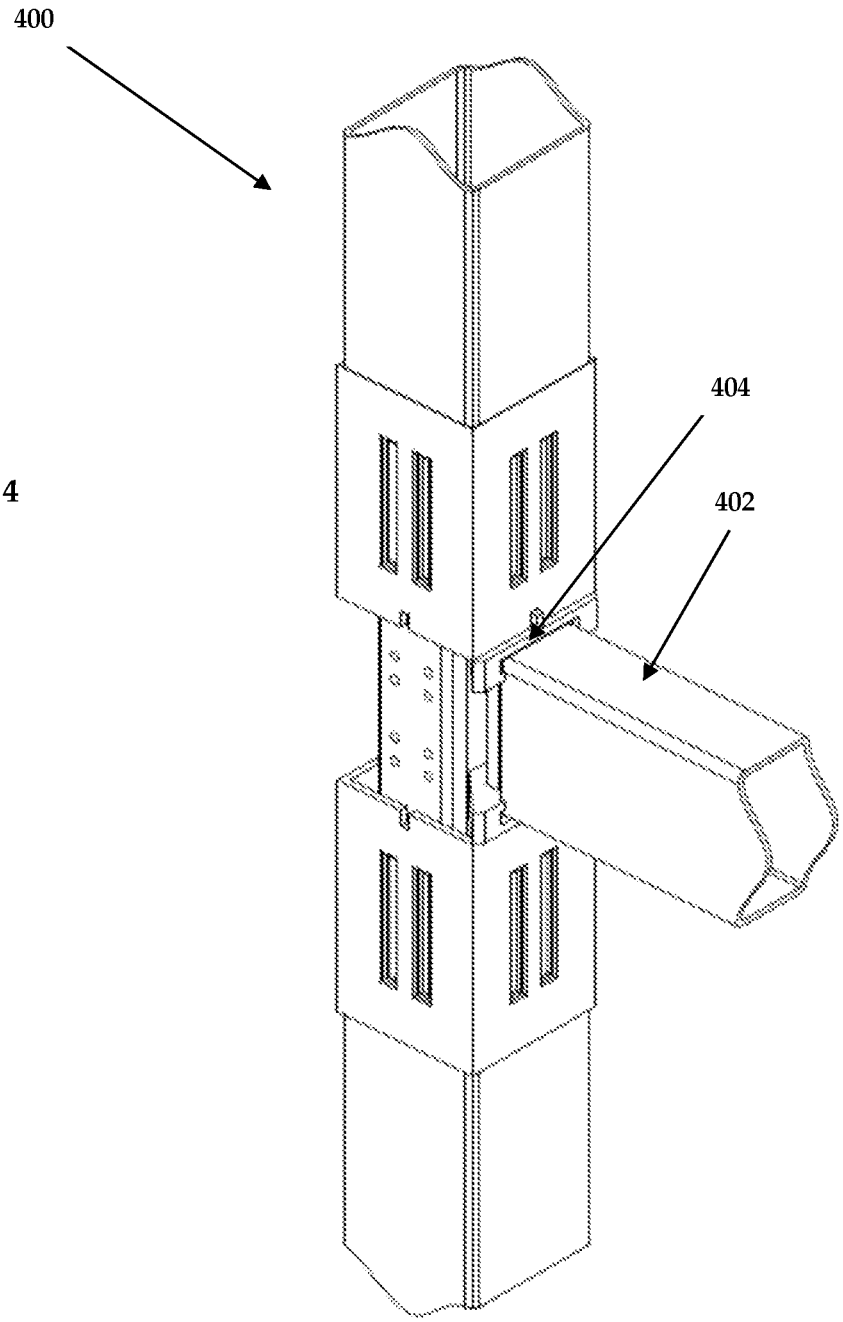
FIG. 4 is an axonometric view of a Hollow Square Section (HSS) columns and beams assembly, according to an exemplary embodiment of the invention.
Figure 5:
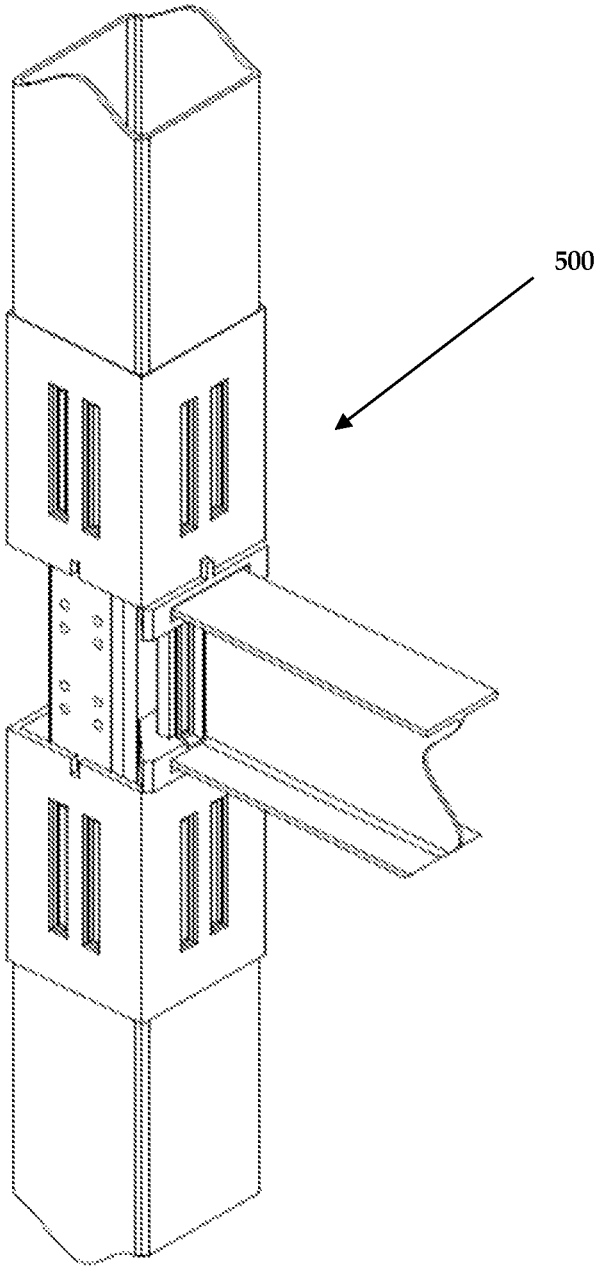
FIG. 5 is an axonometric view of a Hollow Square Section (HSS) column to a steel Wide Flange (WF) beam assembly, according to an exemplary embodiment of the invention.

Load bearing components or beams (FIGS. 3-5) (both horizontal 212/402 and vertical 210/302) can be hollow square sections 210/402 or wide flange beams 212/302. The horizontal beams 212/402 are attached to the bracket at a specially shaped area, customized for either WF beams 206 or HSS beams 404, so that enough interconnection area exists for the horizontal beam 212/402 to be welded, chemically bonded or mechanically coupled/attached (rivets, clips, screws/bolts, etc.). In this fashion, complete pre-cut beam assemblies with attached ends may be shipped to the job site (from a factory setting) or assembled on-site (at ground level). In another embodiment, the attachment coupler 206/404 has some slide openings so the length of the attachment may be adjusted.

The "female" inward terminals 208/209 are similarly attached to the columns via welding, chemical bonding or mechanical coupling to both ends of the column 228. Similarly, length/height adjustment slides may be used. Each terminal 208/209 contains multiple metal latches 218.

Figure 13:
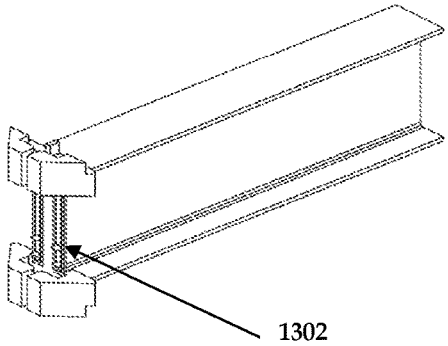
FIGS. 13-14 show axonometric views of a final bracket going into a flange cruciform joint (already having three other brackets seated on a terminal), according to an exemplary embodiment of the invention.
Figure 14:
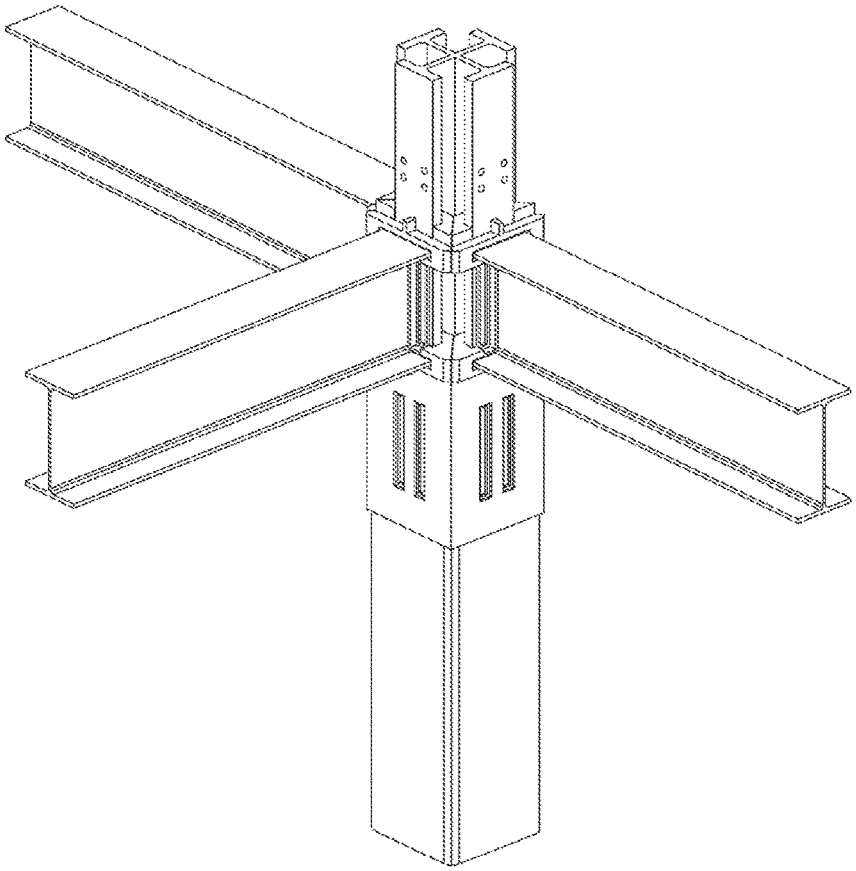
Figure 15:
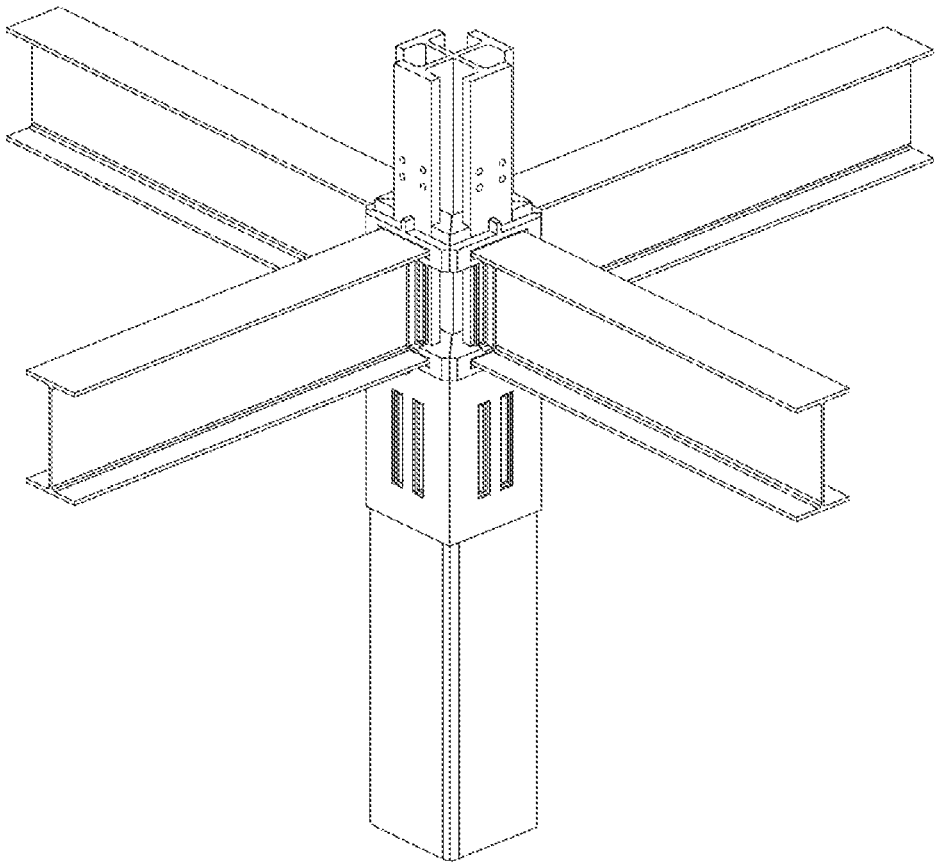
FIG. 15 shows an axonometric view of four brackets mounted on a flange cruciform joint, according to an exemplary embodiment of the invention.
Figure 16:
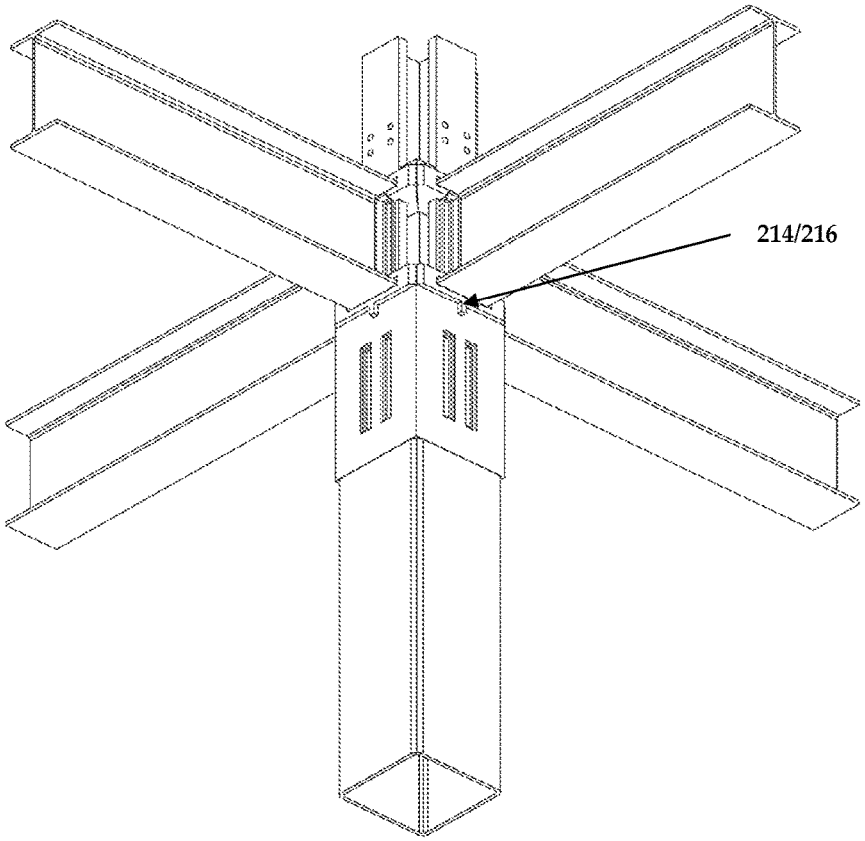
FIG. 16 shows an axonometric view from below of four brackets mounted on a flange cruciform joint showing the tabs from the brackets seated on the corresponding indentations within said terminals, according to an exemplary embodiment of the invention.
Figure 17:
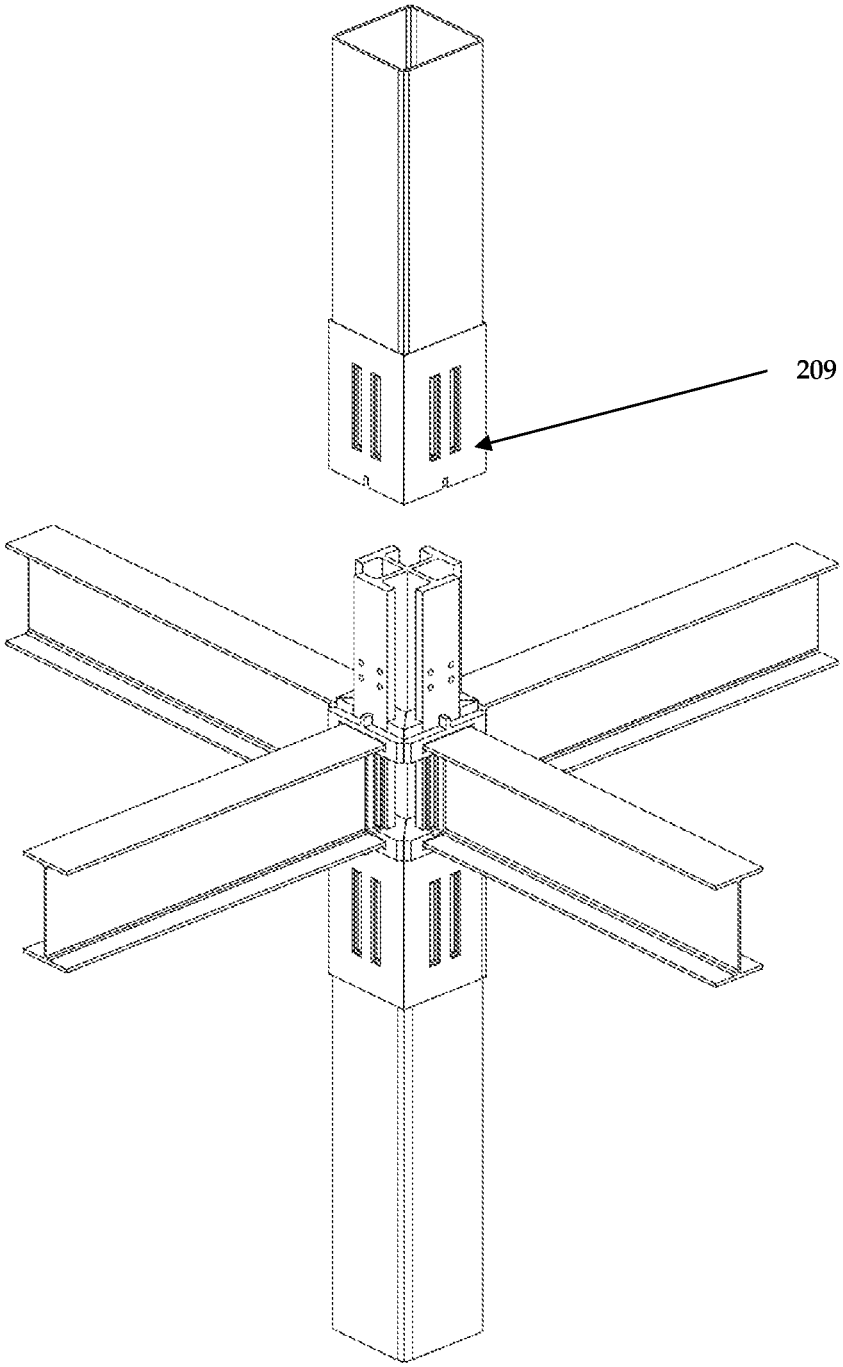
FIG. 17 shows an axonometric view of the upper terminal going into the upper portion of the flange cruciform joint, according to an exemplary embodiment of the invention.
Figure 18:
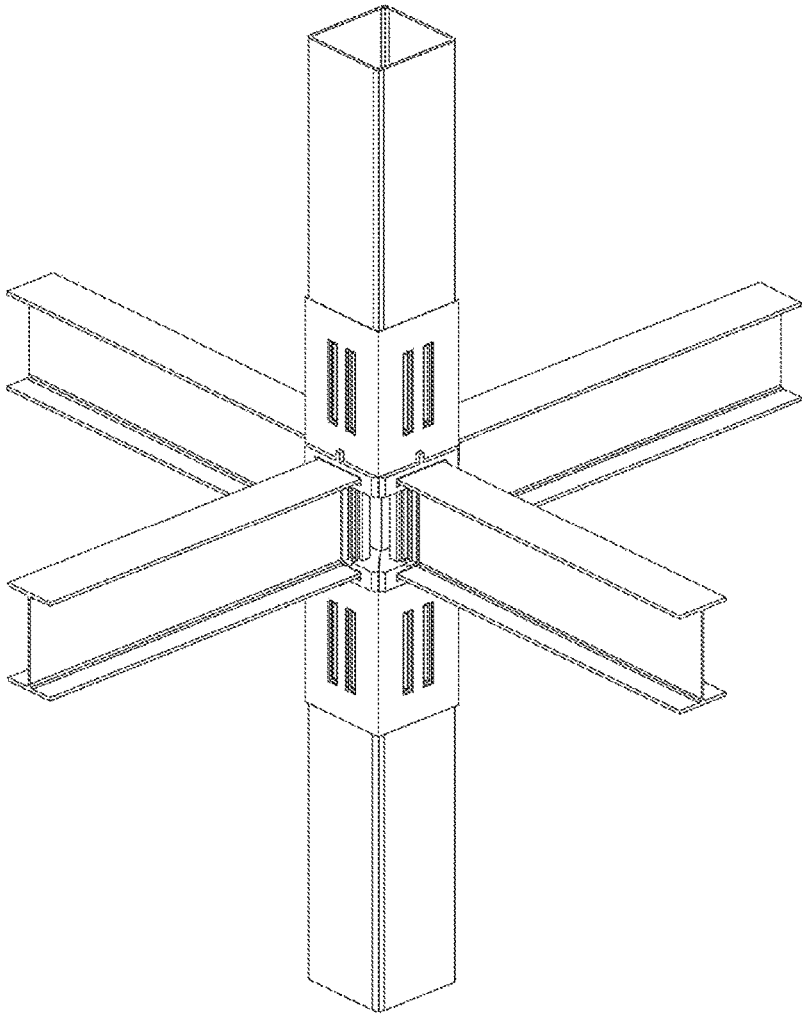
FIG. 18 shows an axonometric view of the upper terminal inserted into the upper portion of the flange cruciform joint, according to an exemplary embodiment of the invention.
Figure 19:
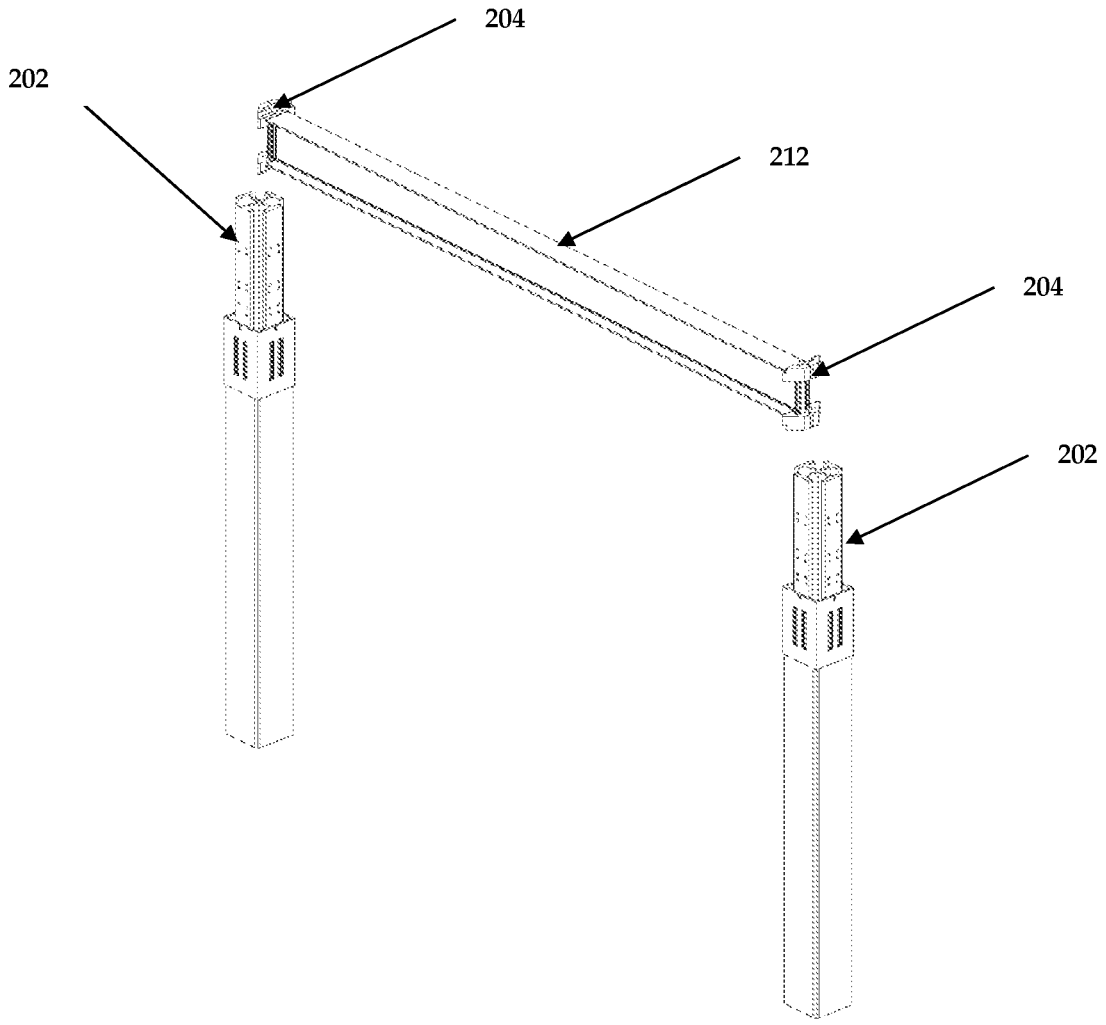
FIGS. 19-20 show axonometric views of a bracket equipped beam (at both ends) going into two columns with terminals having flange cruciform joints mounted on them, according to an exemplary embodiment of the invention.
Figure 20:
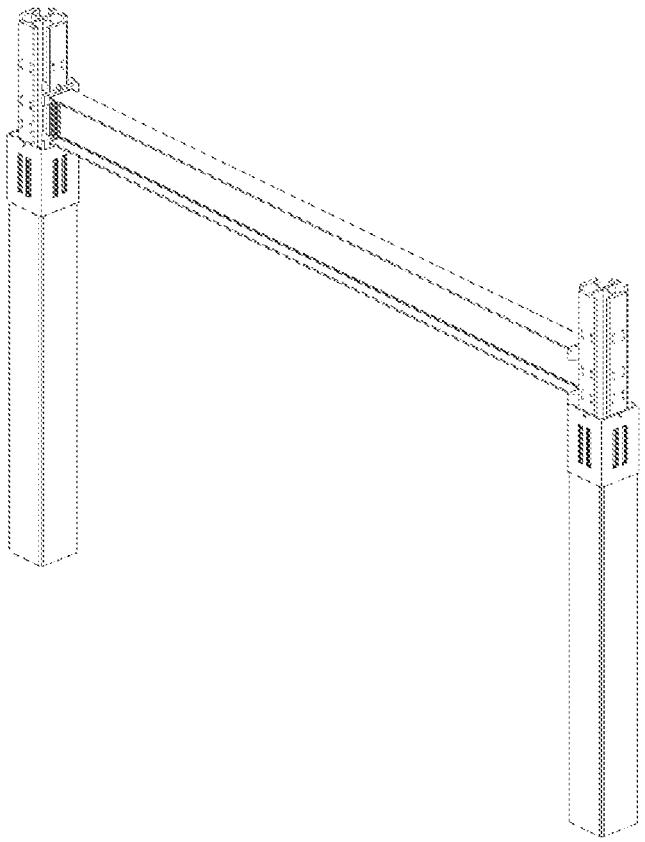
Figure 21:
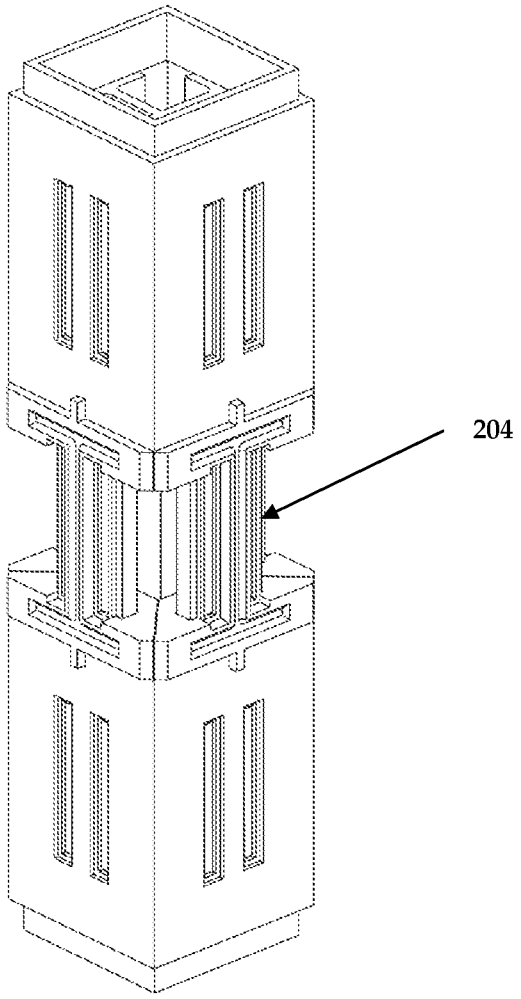
FIG. 21 shows an axonometric view of the upper and lower terminals with four brackets inserted in the middle section, according to an exemplary embodiment of the invention.
Figure 22:
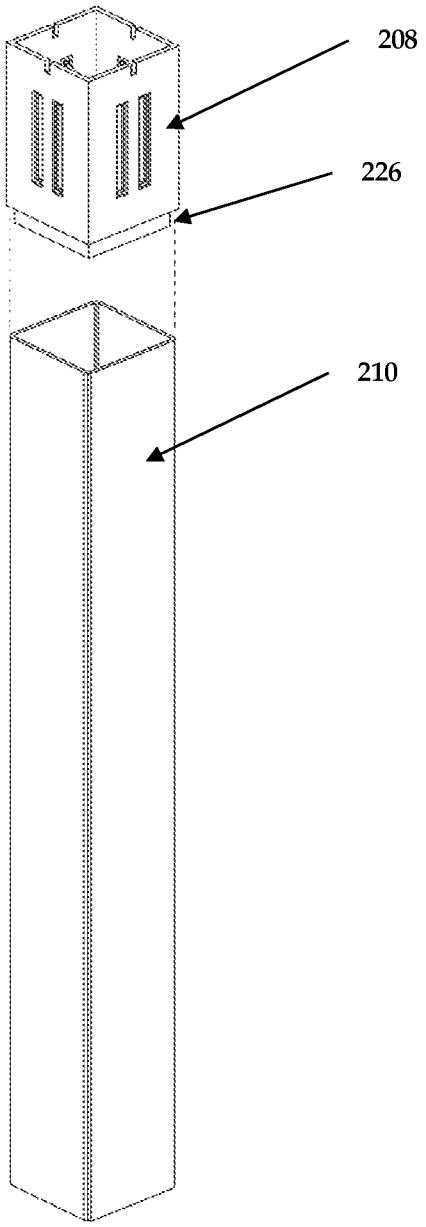
FIG. 22 shows an axonometric view of the lower terminal being inserted into a column for the lower of the flange cruciform joint, according to an exemplary embodiment of the invention.
Figure 25:
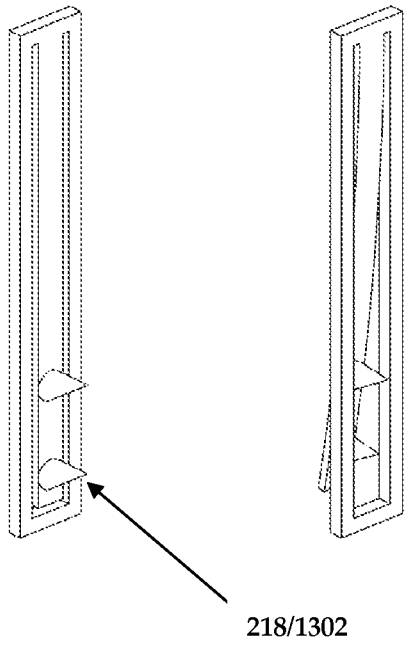
FIG. 25 shows an axonometric view of latches activation action, according to an exemplary embodiment of the invention.
Figure 26:
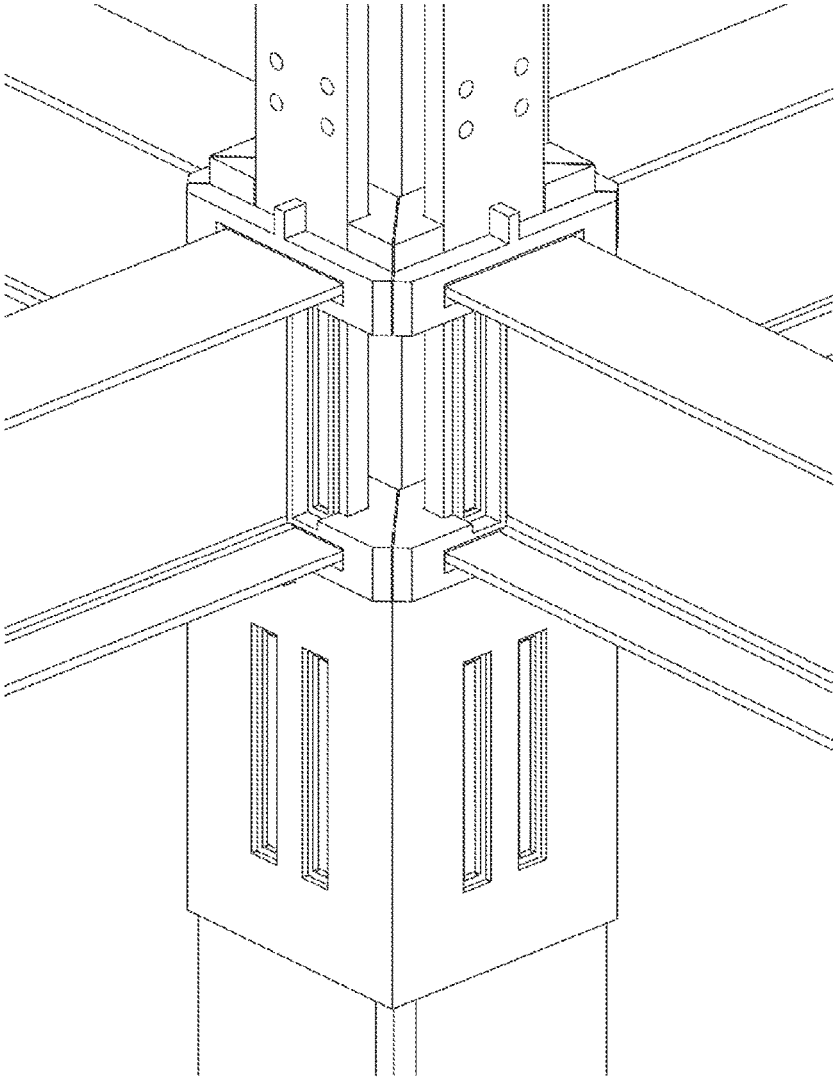
FIG. 26 shows an axonometric view of the brackets fully inserted into the flange cruciform joint, according to an exemplary embodiment of the invention.
Figure 27:
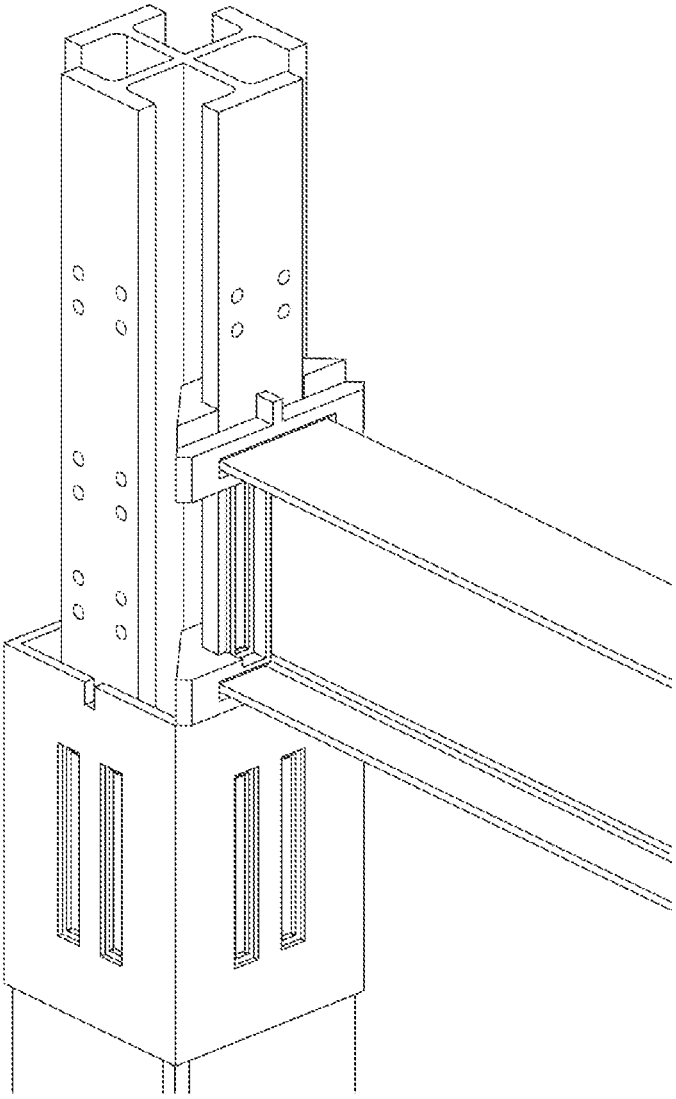
FIG. 27 shows an axonometric view of one bracket fully inserted into the flange cruciform joint, according to an exemplary embodiment of the invention.
Figure 28:
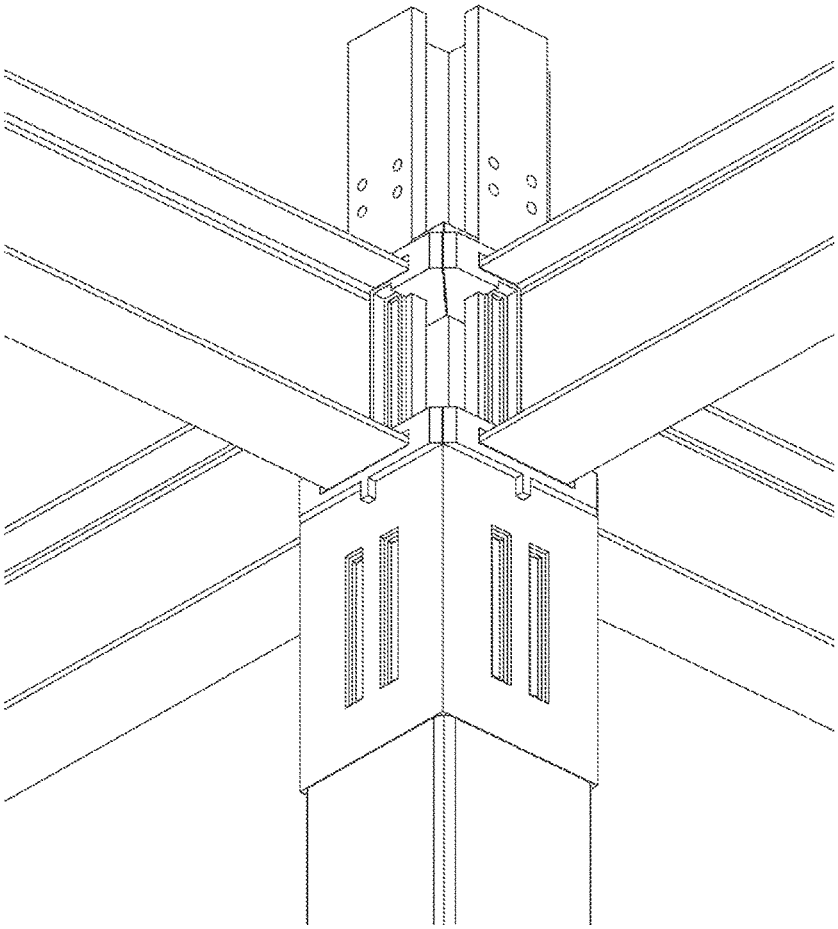
FIG. 28 shows an axonometric view from below of the brackets sitting on the lower terminal, according to an exemplary embodiment of the invention.

Most commonly, the plug 200 is assembled in a gravity fashion, the brackets 204 channel into the flange 202 cruciform joint from top to bottom. The "female" inward shape of the bracket 204 matches the "male" outwardly shape of the flanges 202 in the cruciform joint. The bracket 204 goes lower along the flange 202 until it sits on the column terminal 208 whose indent 216 matches the bracket's indent 214, this interlock assists in avoiding column rotation. As seen in FIG. 13, the bracket 204 has multiple latches 1302 that are complementary to the openings in the flange 224 so as to lock the bracket 204 (and hence the beams 212/402) in the upward direction.

Similarly, the column's upper terminal 209 comes down and locks one or more of said brackets 204 in the downward direction, similarly 'notching' against rotation with the matching top bracket indent to terminal 209 notch. In the upward direction, multiple latches 1302 securely fasten the bracket and its beam to the flange cruciform joint through several holes in its flanges 224. The flange 202 cruciform joint acts as a "male" outwardly component for both the column terminals and the beam brackets. Said joint connects the entire system vertically and horizontally in a bi-axial fashion. All the latches 218/1302 in the column terminals and the beam brackets interlocks with the holes 224 in the flanges 202 of said joint.

Several mechanically-deflecting latches (both on the terminal 208/209, such as 218, as well as on the inside of the bracket 204), act against the flange complementary latch openings 224, in order to lock the entire structural steel plug 200, so that the structure is locked both in the downward and upward directions. The latches 218/1302 geometry allows their shape to deflect when channeling downwardly, but not in the other direction. Said geometry interlocks with the holes 224 in the flanges of the cruciform joint. The latches in both the column terminals 218 and beam brackets 1302 are redundant in performance to improve the plug structural reliability and the structure's safety.

The structural steel plug 200 and, therefore, the resultant structural system is a gravity seat and lock and self-supporting system. The system interlocks sequentially: lower column with terminal 208, flange cruciform joint 202, beams with brackets 204, upper column with terminal 209, and so on for multi-story structures. Both, beam brackets 204 and column terminals 208/209 connected to the flange cruciform joint 202 provides moment, torsion and shear resistance capacity to the structural plug 200 and the resultant structural system.

Figure 6:
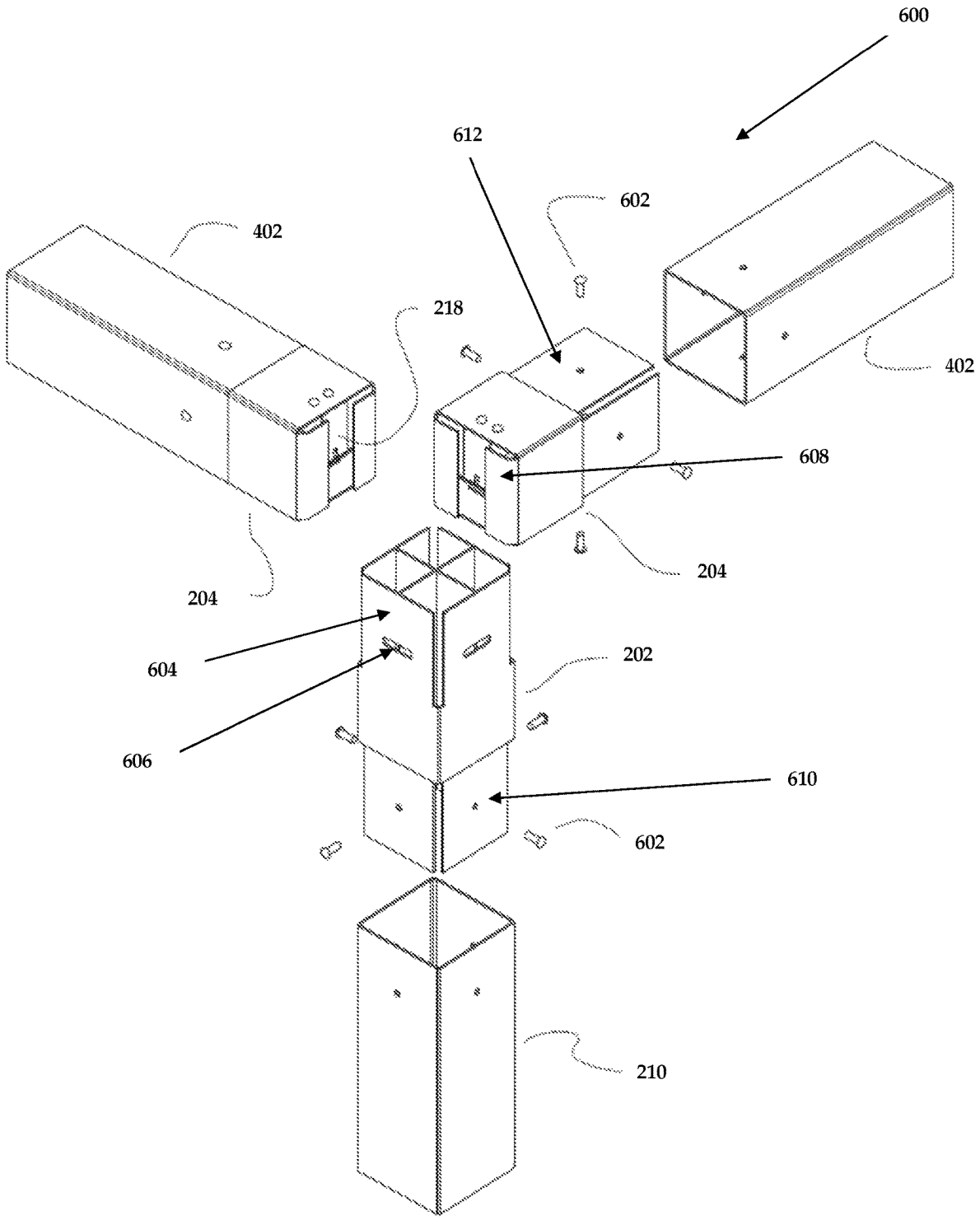
FIG. 6 is an exploded axonometric view of a smaller version of Hollow Square Section (HSS) metal members assembly, according to an exemplary embodiment of the invention.
Figure 7:
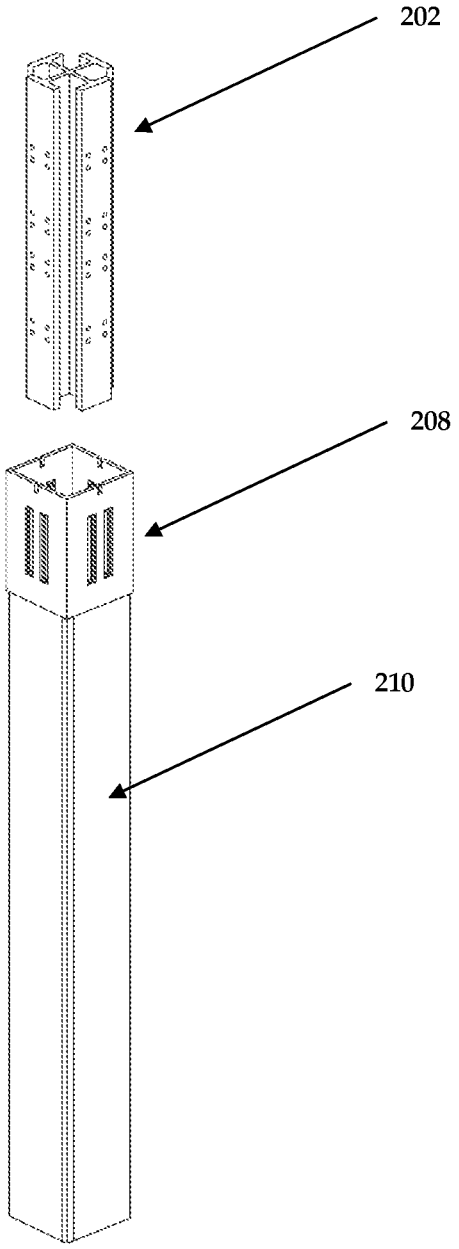
FIG. 7 is an axonometric view of a flange cruciform joint going into a terminal already fitted to a column, according to an exemplary embodiment of the invention.
Figure 8:
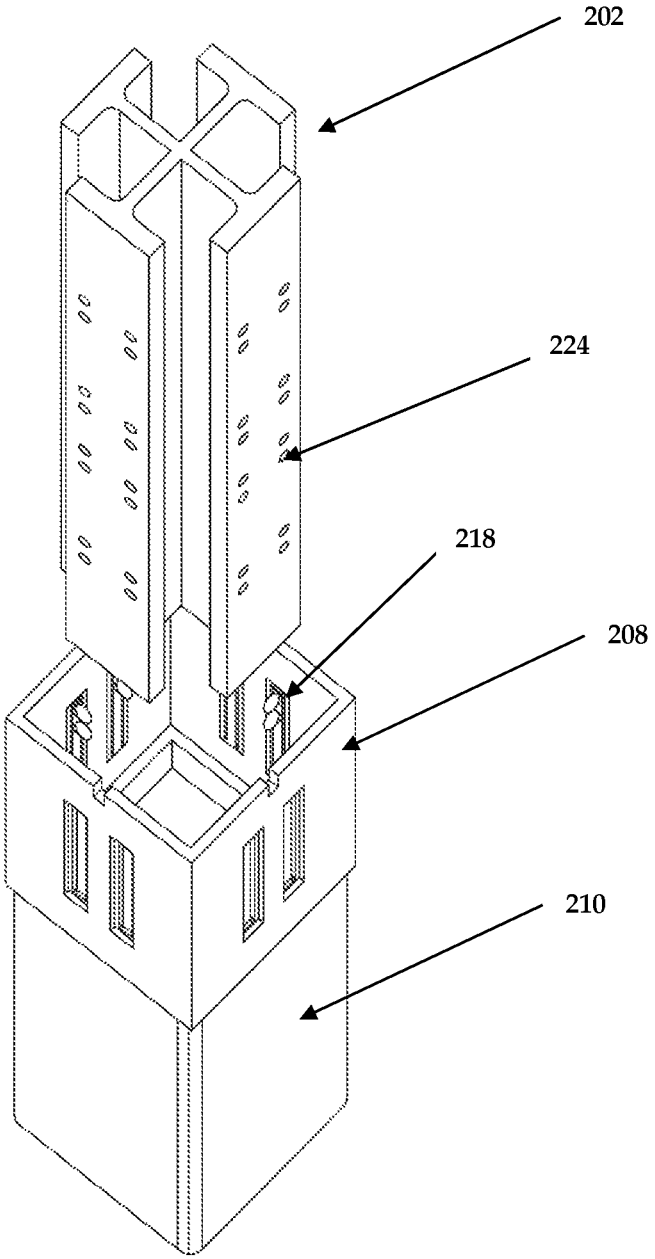
FIG. 8 is an axonometric view of the details of the flange cruciform joint going into a terminal already fitted to a column, with details of the latches, according to an exemplary embodiment of the invention.
Figure 9:
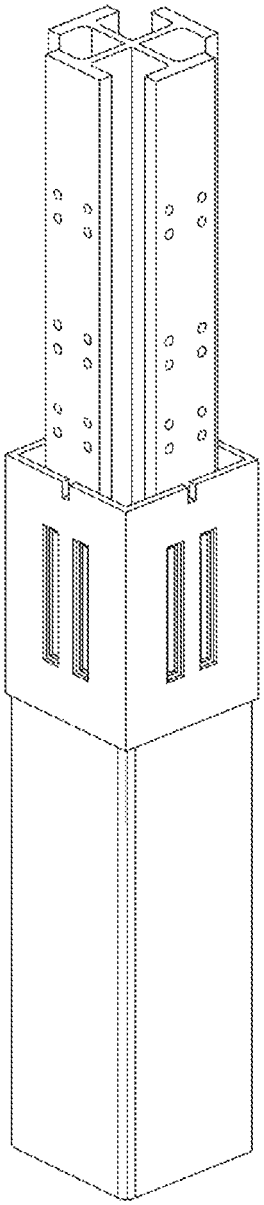
FIG. 9 is an axonometric view of a flange cruciform seated in the terminal already fitted to a column, according to an exemplary embodiment of the invention.
Figure 10:
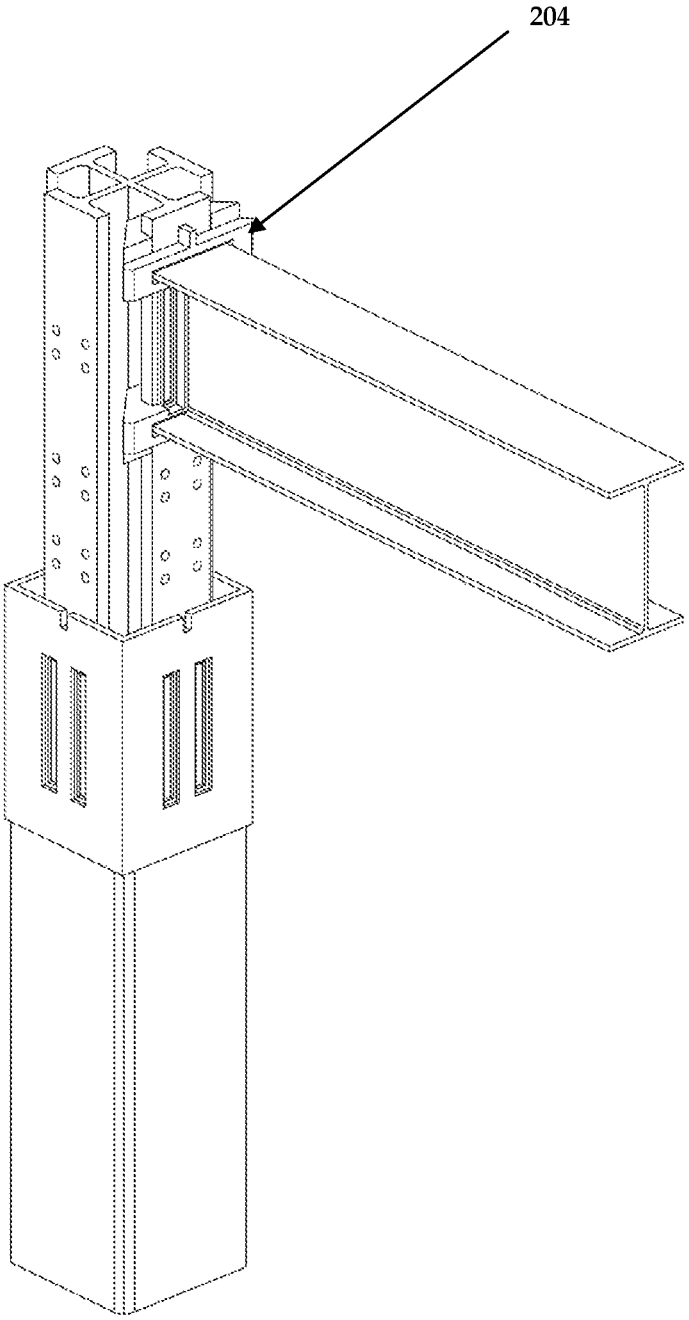
FIG. 10 is an axonometric view of a bracket (having an WF beam already attached) going into a flange already inserted in the terminal and mounted in a column, according to an exemplary embodiment of the invention.
Figure 11:
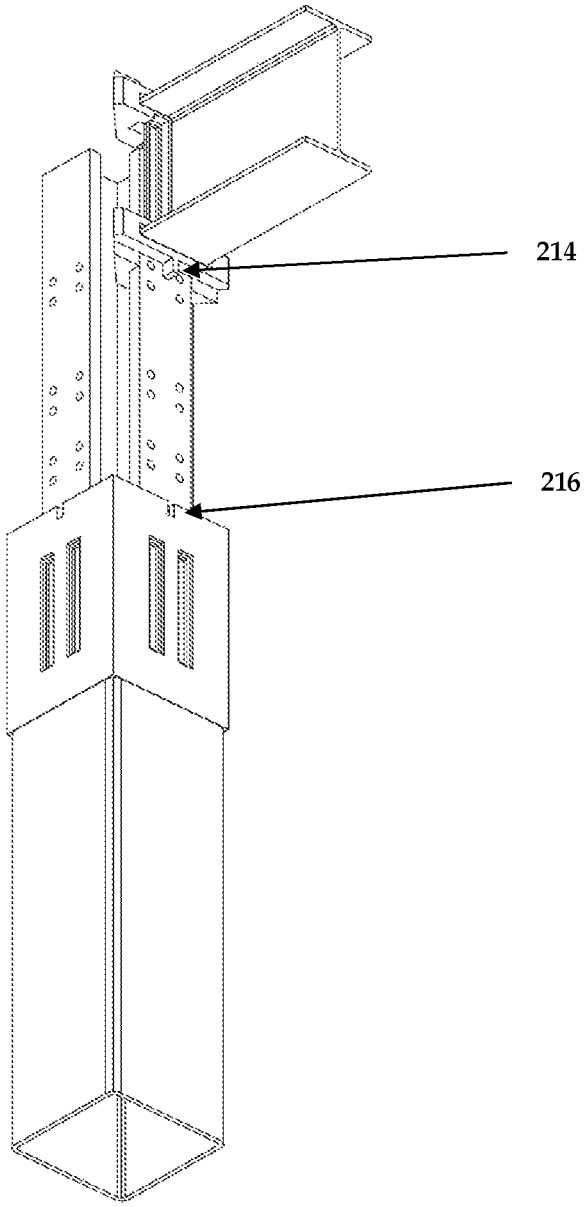
FIG. 11 is an axonometric view from below of a bracket (having an WF beam already attached) going into a flange already inserted in the terminal and mounted in a column, according to an exemplary embodiment of the invention.
Figure 12:
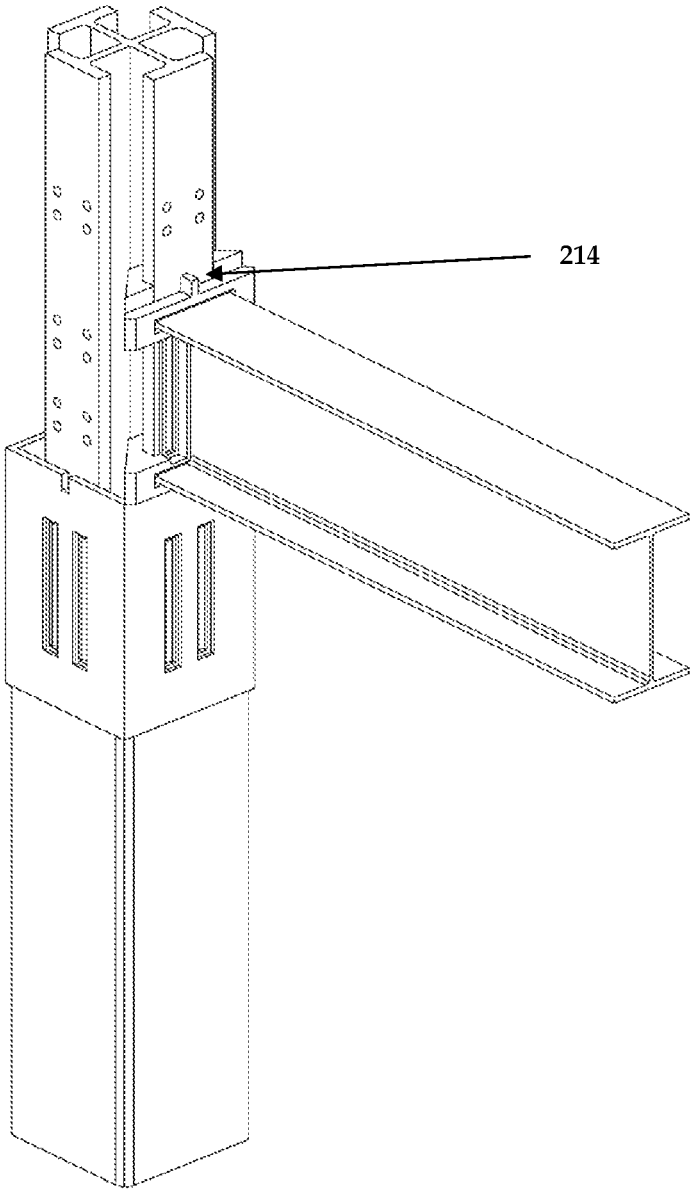
FIG. 12 is an axonometric view of a bracket (having an WF beam already attached) fully inserted into a flange already inserted in the terminal and mounted in a column, according to an exemplary embodiment of the invention.

In another embodiment (FIG. 6) a similar arrangement is seen for smaller structures, having a plug 600 formed from a central flange cruciform joint 202 having one or more sides, where one or more of said sides form an outward flange 604 along whose edges a bracket 204 assembly slides, and a second end comprised of one or more column attachment components 610, themselves a variation of the terminal bottom edge. In one embodiment, the joint 202 slides into the end of the hollow square steel column 210 and are attached to them via attachment components such as rivets, clips or screws 602. In another embodiment, they may be welded or chemically attached to the column 210

The bracket 204 has a first end comprised of two overlapping slides 608 that grasp all or portions of the cruciform joint 202 outward flange and slide down until a deflecting latch 218 built into the fascia of said first bracket side clicks into an opening 606 on said central flange cruciform joint 202 outward flange 604. As with the joint 202, the bracket 204 second end 612 (again, a variation of the terminal end 226) is comprised of one or more beam 402 attachment components. In one embodiment, the brackets 204 slide into the end of the hollow square steel beams 402 and are attached to them via attachment components such as rivets, clips or screws 602. In another embodiment, they may be welded or chemically attached to the beam 402. While shown with HSS steel elements, those skilled in the art can easily see that WF elements may also be used.

In one embodiment, the flange cruciform joint 202 doubled as the HSS column 210 terminal. In the smaller version of the invention, HSS columns are attached to the flange cruciform joint 202 via rivets, clips or screws.

CONCLUSION

In concluding the detailed description, it should be noted that it would be obvious to those skilled in the art that many variations and modifications can be made to the shown embodiments without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "exemplary embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A gravity assisted, standardized structural plug assembly for joining structural members together in an interlocking, bi-axial moment resistant connection, said assembly comprising:

a flange cruciform joint having one or more outward flanges, each said one or more outward flanges having a T-end shape, wherein one or more of said outward flanges has one or more openings along their outward fascia;

one or more column terminals, each said one or more column terminal having a first end featuring a flange cruciform joint nest as well as a column attachment interface, and a second end having an opening so as to fit and host within said column terminal all or a portion of said flange cruciform joint and their outward flange(s);

said column terminal having one or more deflecting latches along one or more of said column terminal sides for latching onto said flange's fascia openings; and one or more inward brackets, each said one or more inward brackets having a first end designed to complementary attach along one said T-end shaped outward flange end, and a second end designed to be permanently coupled to beams, wherein said first end has one or more deflecting latches complementary to the column terminal's outward flange openings.

2. The assembly of claim 1 wherein:

said inward bracket has a side designed to be permanently coupled to one or more beams; and said column terminal has an end designed to be permanently coupled to one column.

3. The assembly of claim 2 wherein:

said inward bracket's side designed to permanently couple to said one or more beam is designed to accomplish this through either mechanical components, welding and/or chemical attachment; and said column terminal's end designed to permanently couple into said column is designed to accomplish this through either mechanical components, welding and/or chemical attachment.

4. The assembly of claim 1 wherein:

said bracket has one or more indentations along said bracket's edge periphery; and said terminal has one or more tabs that are complementary to the bracket's indentations extending from one or more ends of said terminal.

5. The assembly of claim 4 wherein:

said bracket has a side designed to be permanently coupled to one or more beams; and said terminal has an end designed to be permanently coupled to one column.

6. The assembly of claim 5 wherein:

said bracket permanent coupling to said beams is designed to be accomplished through either mechanical components, welding and/or chemical attachment; and said terminal permanent coupling to said column is designed to be accomplished through either mechanical components, welding and/or chemical attachment.

7. A method for assembling a gravity assisted, standardized structural plug assembly for joining structural members together in an interlocking, bi-axial moment resistant connection, said method comprising:

providing a flange cruciform joint having one or more outward flanges, each said one or more outward flanges having a T-end shape, wherein one or more of said outward flanges has one or more openings along their outward fascia;

providing one or more column terminals, each said one or more column terminal having a first end featuring a flange cruciform joint nest as well as a column attachment interface, and a second end having an opening so as to fit and host within said column terminal all or a portion of said flange cruciform joint and their outward flange(s);

said column terminal having one or more deflecting latches along one or more of said column terminal sides for latching onto said flange's fascia openings;

providing one or more inward brackets, each said one or more inward brackets having a first end designed to complementary attach along one said T-end shaped outward flange end, and a second end designed to be permanently coupled to beams, wherein said first end has one or more deflecting latches complementary to the column terminal's outward flange openings; and sitting at least one said flange cruciform joint on at least one said column terminal and sliding at least one said bracket having a beam attached to it on one said outward flange, then attaching said terminal to a column and capping said flange cruciform with an upper terminal.

8. The method of claim 7 wherein:

said inward bracket has a side designed to be permanently coupled to one or more beams; and said column terminal has an end designed to be permanently coupled to one column.

9. The method of claim 8 wherein:

said inward bracket's side designed to permanently couple to said one or more beam is designed to accomplish this through either mechanical components, welding and/or chemical attachment; and said column terminal's end designed to permanently couple into said column is designed to accomplish this through either mechanical components, welding and/or chemical attachment.

10. A gravity assisted, standardized structural plug assembly for joining structural members together in an interlocking, bi-axial moment resistant connection, said assembly comprising:

a flange cruciform joint having one or more outward flanges, each said one or more outward flanges having a T-end shape, wherein one or more of said outward flanges has one or more openings along their outward fascia;

one or more column terminals, each said one or more column terminal having a first end featuring a flange cruciform joint nest as well as a column attachment interface, and a second end having an opening so as to fit and host within said column terminal all or a portion of said flange cruciform joint and their outward flange(s);

said column terminal having one or more deflecting latches along one or more of said column terminal sides for latching onto said flange's fascia openings; and one or more inward brackets, each said one or more inward brackets having a first end designed to complementary attach along one said T-end shaped outward flange end, and a second end designed to be permanently coupled to beams, wherein said first end has one or more deflecting latches complementary to the column terminal's outward flange openings.

* * * * *